US008941306B2

(12) United States Patent
Ayres

(10) Patent No.: US 8,941,306 B2
(45) Date of Patent: Jan. 27, 2015

(54) MOMENTARY NIGHT LIGHT ASSEMBLY

(71) Applicant: John Alfred Ayres, Lapeer, MI (US)

(72) Inventor: John Alfred Ayres, Lapeer, MI (US)

( * ) Notice: Subject to any disclaimer, the term of this patent is extended or adjusted under 35 U.S.C. 154(b) by 0 days.

(21) Appl. No.: 13/766,740

(22) Filed: Feb. 13, 2013

(65) Prior Publication Data

US 2013/0169169 A1 Jul. 4, 2013

Related U.S. Application Data

(63) Continuation of application No. 12/451,694, filed as application No. PCT/US2008/058966 on Apr. 1, 2008, now Pat. No. 8,378,596.

(51) Int. Cl.

| | |
|---|---|
| ***H05B 37/02*** | (2006.01) |
| ***H05B 33/08*** | (2006.01) |
| ***F21V 33/00*** | (2006.01) |

(52) U.S. Cl.

CPC ..... *H05B 33/0854* (2013.01); *F21V 33/0052* (2013.01)

USPC ..... 315/152; 315/149; 315/153

(58) Field of Classification Search

CPC ..... H05B 33/0833; H05B 33/0854; H05B 33/0845; H05B 33/0884; F21V 33/00; F21V 33/0052; F21V 33/0064

USPC ..... 315/149–159, 291, 307–308; 362/145–148, 153–153.1, 166, 205, 362/641–642, 230–231

See application file for complete search history.

(56) References Cited

U.S. PATENT DOCUMENTS

| | | | | |
|---|---|---|---|---|
| 5,803,579 | A * | 9/1998 | Turnbull et al. | 362/516 |
| 2005/0087675 | A1* | 4/2005 | Ayres | 250/214 R |
| 2005/0236998 | A1* | 10/2005 | Mueller et al. | 315/51 |
| 2006/0149607 | A1* | 7/2006 | Sayers et al. | 705/7 |
| 2011/0133655 | A1* | 6/2011 | Recker et al. | 315/159 |

* cited by examiner

*Primary Examiner* — Tuyet Thi Vo
*Assistant Examiner* — Henry Luong

(57) ABSTRACT

This invention is a night light assembly containing a multiple LED light source and an electronic controller whereby the electronic controller causes the multiple LED light source to continually change its light output from a high intensity photopic light output to a low intensity scotopic light output in response to a transition from light to dark of an ambient light, matching a human eye response to a sudden decrease in ambient light.

14 Claims, 18 Drawing Sheets a)
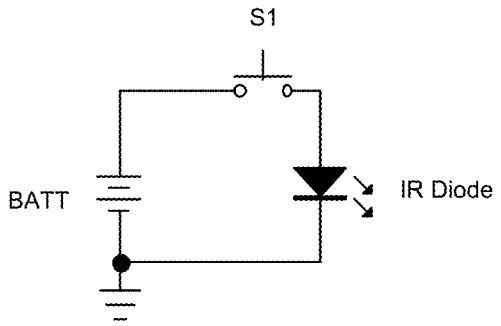
b)
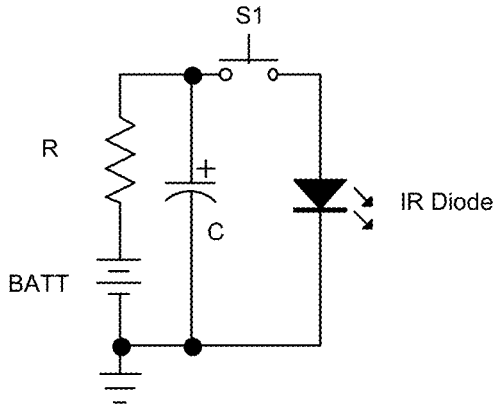
c)
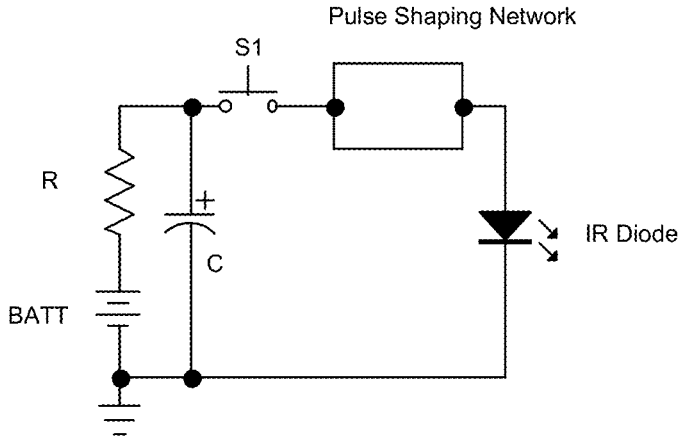
FIGURE 27

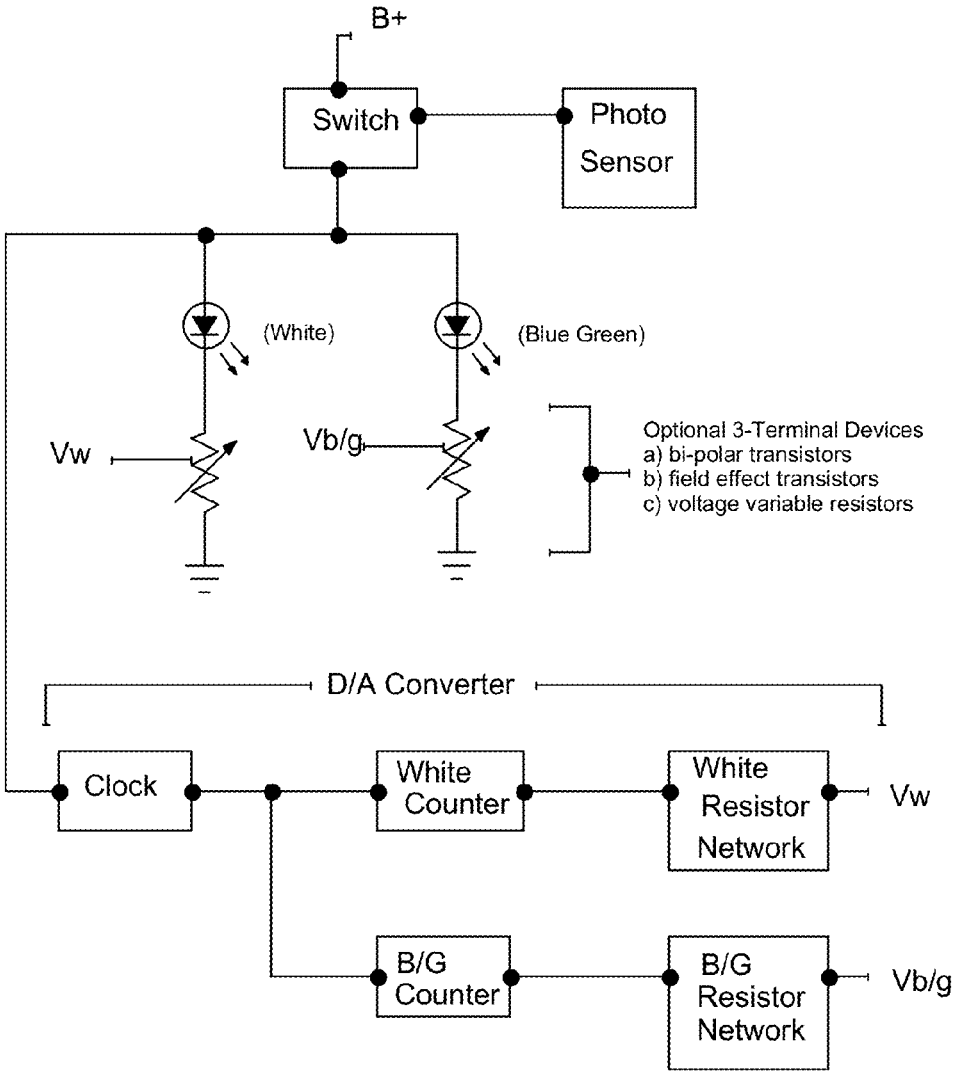
Optional Micro Controller Implementation
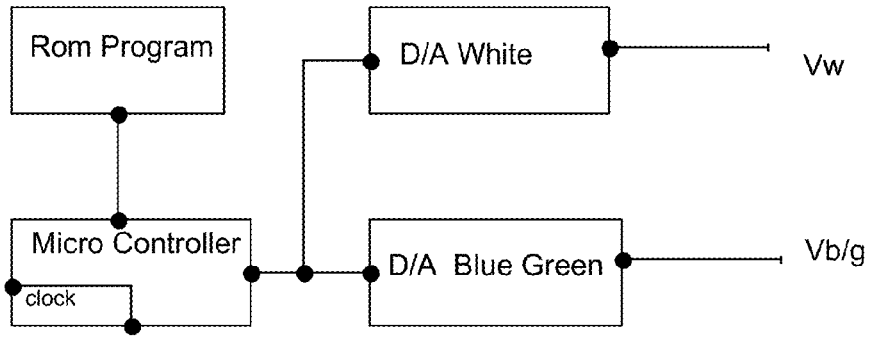
FIGURE 41

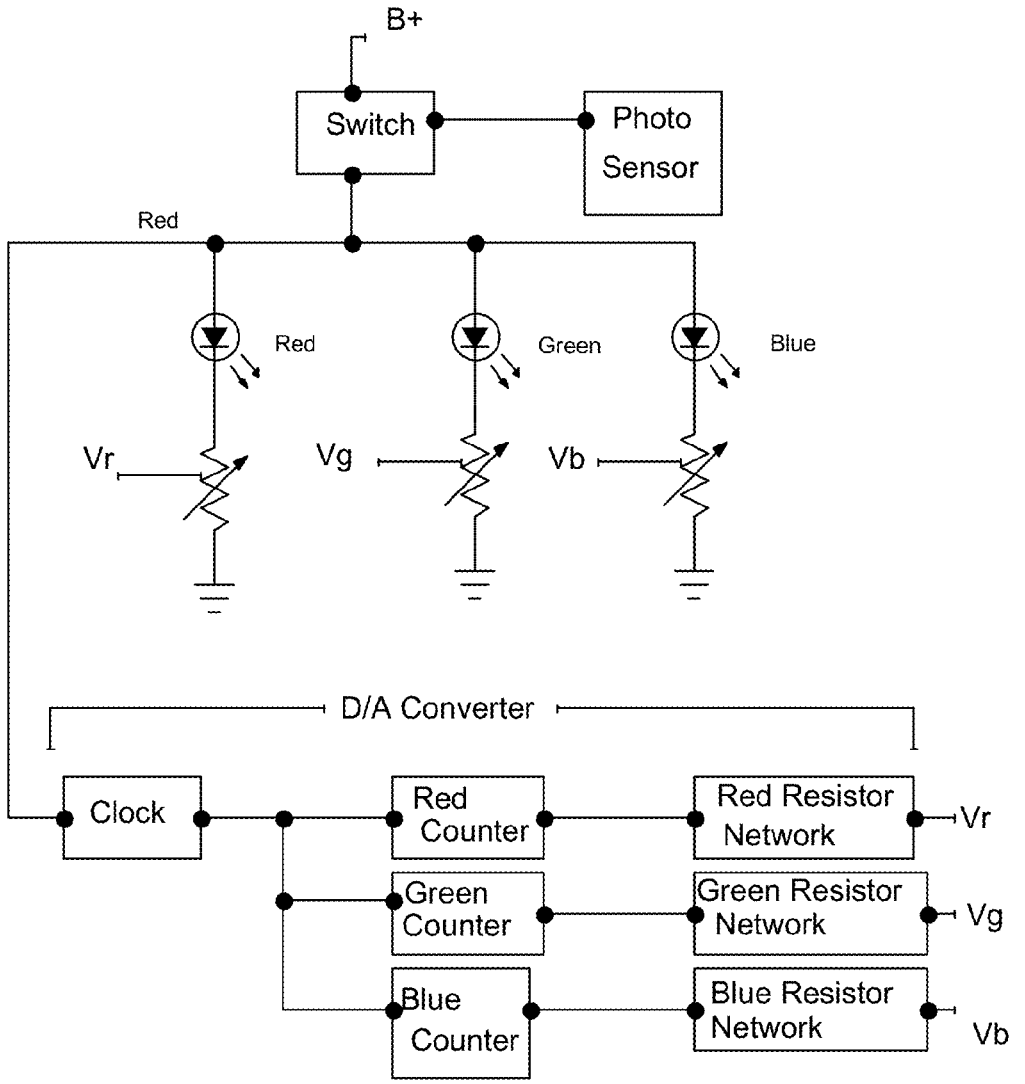
Optional Micro Controller Implementation
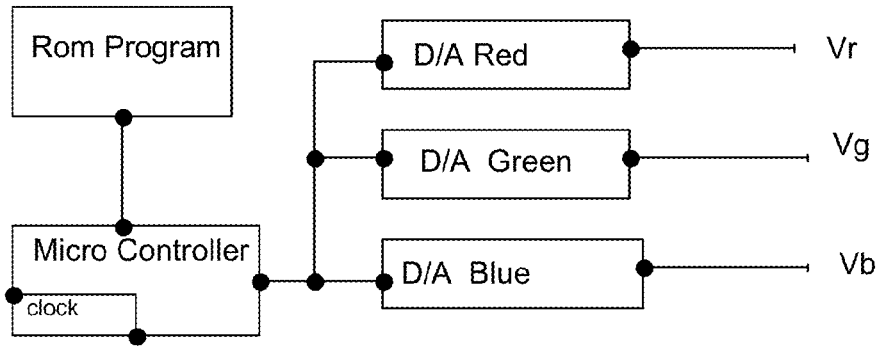
FIGURE 42

MOMENTARY NIGHT LIGHT ASSEMBLY

This patent application is a division of application Ser. No. 12/451,694.

BACKGROUND ART

1. Field of the Invention

This invention relates to assemblies used as night lights. More specifically, the invention relates to light assemblies that provide momentary lighting and provide other full time night light functions integrated within the momentary night light assemblies. This invention is a further extended and modified application of the momentary secondary light source described in U.S. Pat. No. 7,253,570.

2. Description of the Related Art

U.S. Pat. No. 7,253,570 describes "Automatic Momentary Secondary Light Source Assembly" that perform a special night light function by sensing the rate of change of ambient light and automatically lighting an enclosure for a fixed amount of time. It slowly turns off following the predetermined time period.

U.S. Pat. No. 5,422,544 discloses a lighting controller that prevents a rapid change in the intensity of a single light source by sensing the ambient light in a controlled space and gradually reducing it to match a predetermined rate function corresponding to adaptability of the human eye to changes in luminance. The wavelength spectrum of the light source is fixed by the light source chosen and is not controlled by the lighting controller.

U.S. Pat. No. 5,015,924 discloses a lighting system having at least two independent lighting subsystems each with a different ratio of scotopic to photopic illumination. The object is to control the dilation and contraction of the eye pupil by adjusting the level of scotopic illumination independently of the level of photopic illumination. This lighting system uses fixed filters to adjust the light wavelength from one source into the photopic range and the wavelength from the second source into the scotopic range. The ratio of the two light intensities is then varied to provide a response from the eye that controls the pupil size while holding the level of photopic illumination constant. This allows an increase in acuity and depth of field without increasing the overall brightness of the light source. No attempt is made to reduce the level of photopic illumination while increasing the level of scotopic illumination such as would be required in a controlled space where optimum night adaptation of the eye is required.

U.S. Pat. No. 6,917,154 discloses a Scotopic After-Glow Lamp having a Fluorescent Bulb with a non-uniform blend of scotopic enhanced phosphors and After-Glow phosphors. The scotopic phosphor blend prepares the eye to respond and adapt quickly to the after-glow light if the lamp power is turned off. When the lamp is turned off it glows at about 490 nm (nano-meters), thus enhancing scotopic vision while it glows.

US Patent Publication No. 2002/0067608 discloses an externally powered LED Flashlight utilizing an ultra-bright LED light source to achieve bright light output at low power consumption. The flashlight is powered by the batteries in a portable electronic device such as a cellular phone, a portable radio, or a personal data appliance. The flashlight connects to the battery in the portable device through a plug that is inserted into the AC adapter receptacle of the devise. It has a simple on-off switch, but no other method of light control is used.

None of these references disclose a controlled momentary night light, either singly or in combination with other supplemental lights, such as glowing lights, regular night lights, or scotopic night lights, nor do they disclose applications of these in other products.

SUMMARY OF THE INVENTION

A momentary night light has been developed that provides a turn-on rate threshold, and a slow turn-off feature using only a single capacitor. This momentary night light can also be manually reset and provides for an after-glow feature that helps to locate the momentary night light in the dark to facilitate a manual turn-on of the light if desired. In one version, four independently adjustable control features are shown which improve the performance of the momentary night light in battery powered and 110 volt AC designs. The momentary night light of this invention can be easily remote controlled using very simple and inexpensive circuits and an infrared LED. This is an especially useful feature for momentary night lights when they are designed into other products, such as toys and consumer electronic products that are also used to provide momentary night lights in addition to their normal functions. Battery operated versions of this invention require very low current when operated in the Scotopic range of vision of a user, and thus provide economical long life and can be designed to be recycled or disposed of at the end of battery life. A variation of the momentary night light includes multiple stage battery operated versions controlled by timing functions and having white and/or multicolor LEDs to optimize mesopic and scotopic vision of the user. These may be integrated into cell phones, PDA's, MP3 Players, and personal computers. The display backlight normally used with many of these devices can be programmed through a menu or directly through a keypad to set the desired user characteristics such as multiple timed backlight intensity and color to provide for custom portable momentary nightlights. In addition, light sources other than the display backlight may be built into the handheld device or computer. Finally, external plug-in momentary nightlights are provided which have their own battery or take their power from the hand-held device or computer, have their own memory, and may be plugged into a USB bus or some other connector or port.

BRIEF DESCRIPTION OF THE DRAWINGS

Advantages of the invention will be readily appreciated as the same becomes better understood by reference to the following detailed description when considered in connection with the accompanying drawings, wherein:

FIG. 27 shows three different remote control circuits showing a nineteenth embodiment of the momentary night light assembly of this invention.

FIG. 41 is a time variable night light schematic showing a twenty second embodiment of the momentary night light assembly of this invention.

FIG. 42 is a time variable night light schematic showing a twenty third embodiment of the momentary night light assembly of this invention.

DETAILED DESCRIPTION OF THE PREFERRED EMBODIMENTS

Figure 1:
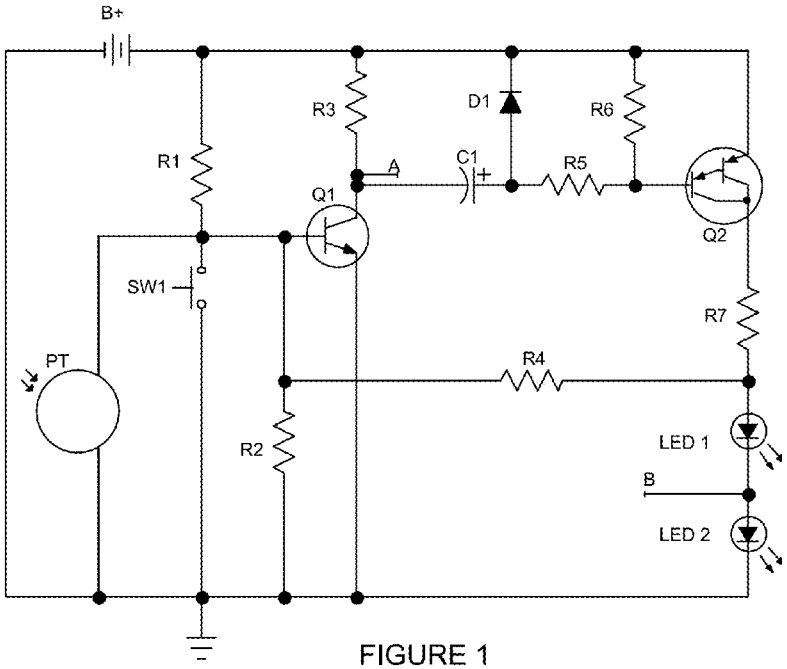
FIG. 1 is an electrical schematic showing a first embodiment of the momentary night light assembly of this invention.

FIG. 1, a first embodiment of the invention, is an electrical schematic for the single capacitor, dual LED, momentary night light assembly. It has been designed to operate from three lithium 3 volt coin cells in series to provide between 8 and 9 volts for operation. Pt is an infrared transistor switch that connects the base of Q1 to ground when the ambient light is on or bright. When the ambient light is turned off, or is very low, Pt turns off, turning on Q1 through resistors R1 and R2. When Q1 turns on, capacitor C1 charges through R5 and R6, turning on Q2 (which is typically a high current gain Darlington transistor), which provides current to drive the dual LED through resistor R7. As C1 reaches a charged state the current through it reduces to the point that Q2 starts to turn off gradually. This results in a slow turn-off feature that provides a pleasant slow reduction of light from the LEDs. R4 provides a feedback path from Q2 to Q1 to provide a more positive latch to maintain the current to the LEDs until C1 is fully charged. R4 also makes the circuit less sensitive to light feedback from the LEDs to the phototransistor, Pt. This circuit can be operated without R4, but careful consideration must be given to the relative physical placement of the LEDs and Pt in order to prevent the LEDs from turning themselves off by casting light on Pt. R3 and D1 provide a low impedance discharge path for discharging C1 when Q1 is off. This provides a fast reset feature so that the night light can be turned back on soon after a turn-off event. Resistors R5 and R6 can be selected to provide a turn-on threshold for Q2 that will not turn on Q2 when C1 is very slowly charged by the gradual turn-on of Q1, such as would happen when the ambient light reduces very slowly. This prevents the night light source from turning on when the sun goes down, and provides light only with a more rapid reduction of ambient light, such as the turning off of a room light, thus providing longer battery life in a battery powered momentary night light assembly. Switch S1 is provided for a manual reset of the momentary night light. The dual series connected LED systems with higher battery voltage (9V) can provide up to 34% higher efficiency when compared to single LED systems. This is accomplished with 50% higher battery voltage. This is important to give a throw-a-way momentary night light a longer operating life.

Figure 1A:
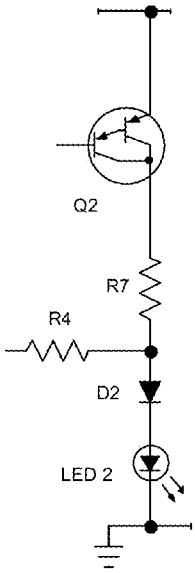
FIG. 1*a* is a schematic showing a diode replacement for one of the LEDs of FIG. 1.

FIG. 1*a* shows that one LED of FIG. 1 can be replaced by a diode which would also allow a reduction in battery voltage to two coin cells or about 4.5 to 6 volts.

Figure 2:
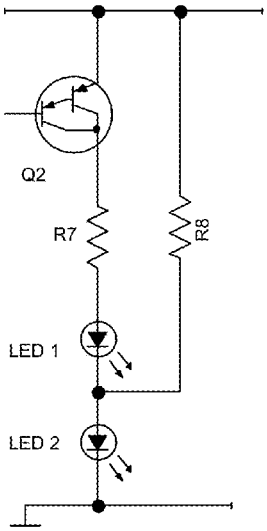
FIG. 2 is a schematic of a glow feature showing a second embodiment of the momentary night light assembly of this invention.

FIG. 2 shows a resistor R8 provided to supply a continuous small (typically 2 to 6 micro amps) current to cause the lower LED to glow in the dark. This allows a user of the momentary night light source to "find" the unit in the dark for the purpose of a manual reset. This circuit does waste some battery power in the daytime when the ambient light is high; however, it is simple and inexpensive.

Figure 3:
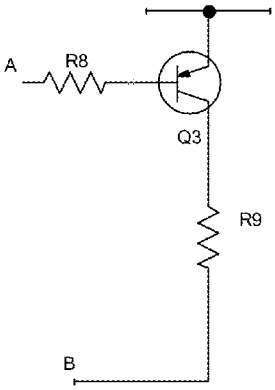
FIG. 3 is a schematic for a transistor powered glow feature showing a third embodiment of the momentary night light assembly of this invention.

FIG. 3, is an embodiment of the invention that shows a "niteglo" circuit that connects to points "A" and "B" in FIG. 1 and provides the same function discussed with FIG. 2, except current is supplied to the LED 2 only at night. This is accomplished by connecting a transistor Q3 to the collector of Q1 through resistor R8. R9 controls the current level in LED 2. This circuit can also provide higher levels of current (more than a few micro amps) in LED 2. A few hundred micro amps up to a few milliamps can be provided to make a combination momentary night light and a regular nightlight.

Figure 3A:
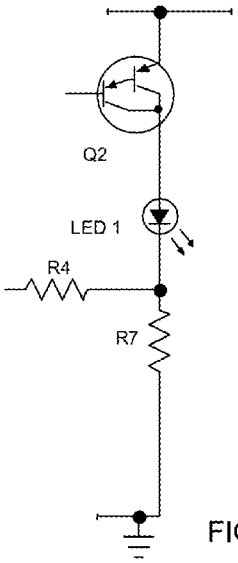
FIG. 3*a* is an alternate schematic of a single LED version of FIG. 1.

FIG. 3*a* shows an alternate configuration of a single LED and resistor to provide feedback through R4.

Figure 4:
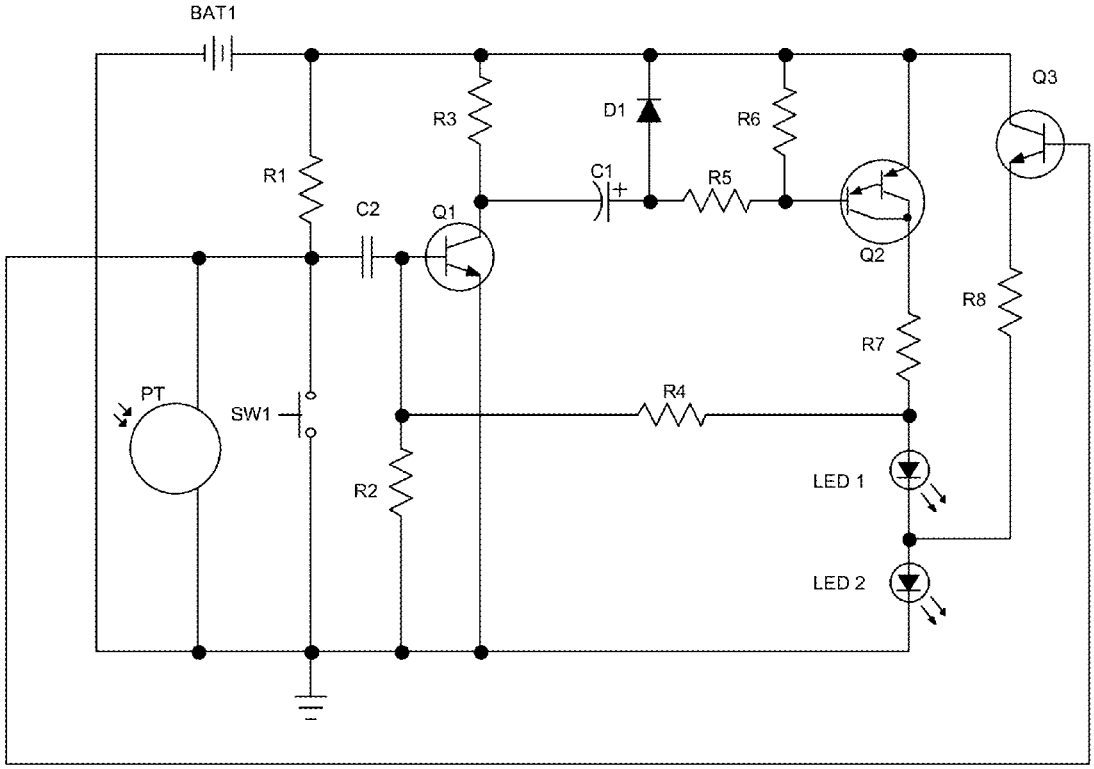
FIG. 4 is an electrical schematic showing a fourth embodiment of the momentary night light assembly of this invention.

FIG. 4 is an embodiment that shows the same electrical circuit as shown in FIG. 3 except C2 has been added and Q3 is an npn emitter-follower. The addition of C2 allows the momentary night light assembly to be adjusted to various rates of change of ambient light in order to turn on the LEDs at different calculated rates. The combination R1, C2, and R2 determine the rate threshold at which the LEDs turn on. Making R1 smaller and/or C2 larger makes the momentary night light more sensitive to a change in ambient light intensity. C2 also de-couples the LED light from the photo sensor (Pt) so that light feedback effect is minimal. This allows the photo sensor and the LEDs to be placed in close proximity without interference.

Figure 5:
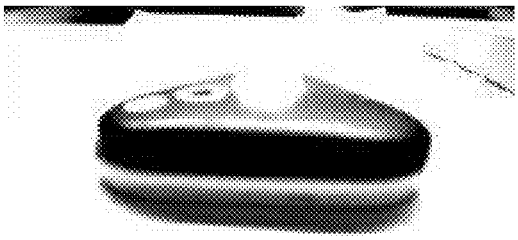
FIG. 5 is an edge view of a triangular shaped momentary night light assembly.
Figure 6:
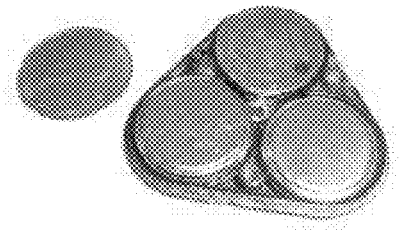
FIG. 6 is an open plan view showing three batteries in a triangular shaped momentary night light assembly.
Figure 9:
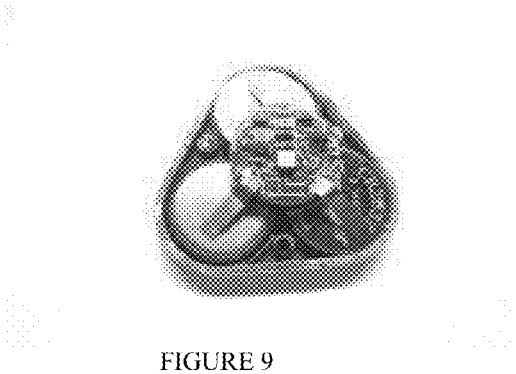
FIG. 9 is an open plan view showing a sixth embodiment of the momentary night light assembly of this invention.
Figure 10:
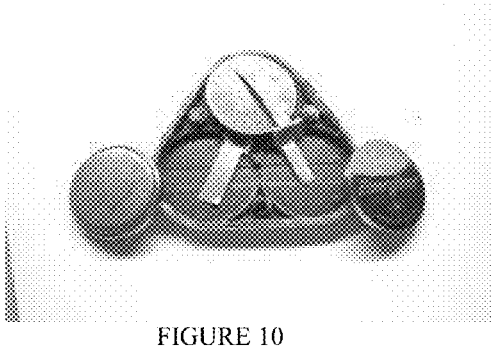
FIG. 10 shows the connecting tabs in relationship to the batteries in a triangular shaped case showing a seventh embodiment of the momentary night light assembly of this invention.
Figure 11:
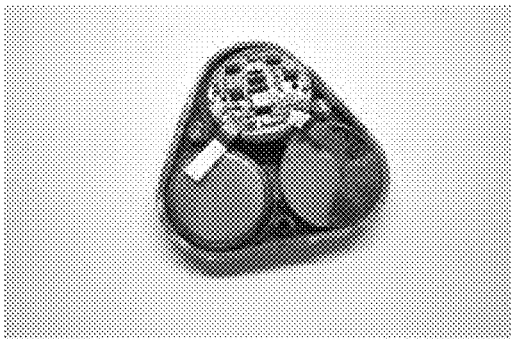
FIG. 11 is an open plan view of a triangular shaped assembly with two batteries and a circuit board assembly showing an eighth embodiment of the momentary night light assembly of this invention.
Figure 12:
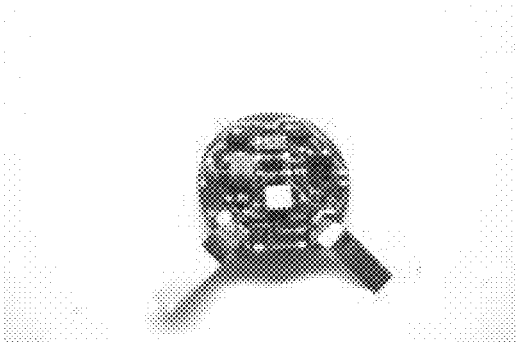
FIG. 12 is a circuit board with tabs showing a ninth embodiment of the momentary night light assembly of this invention.

The embodiments of FIGS. 5, 6, 7, and 8 show designs for battery powered momentary night light assemblies. FIG. 5 is a side view of a small light containing the circuit shown in FIG. 4. It has a small fresnel lens over the LEDs and a separate light sensor (Pt) opening. The lens is a type 5118 sold by 3Dlens.com. It contains 18 fresnel lenses with a total 120 degree viewing angle. It is made from high density polyethylene and easily passes infrared and higher frequency radiation. It functions both as an efficient light spreading lens and an infrared focusing lens when used with an external remote control. This type of lens does an excellent job of spreading the light from LED chips so that an entire room can be illuminated from a small light source such as those contained in this invention. This prevents a very bright spot when looking directly at the momentary night light and consequently is much easier on the eyes of a user. FIG. 6 shows the inside battery configuration of the light shown in FIG. 5. Here, 3 CR2032 lithium coin cells are used in series to provide the voltage required in the two LED system described with FIGS. 1, 3, and 4. When a one LED system is used, one of the three batteries can be replaced by a circular micro circuit assembly and the overall triangular package can be further reduced in thickness. FIG. 11 illustrates this two battery system. The microcircuit can be a very small surface mount assembly on a hard board or ceramic substrate which lies between the batteries and top case. This construction can be seen in FIGS. 9, 10, and 11. Connections to the batteries are made through interconnecting tabs between batteries and tabs soldered directly to the circuit assembly. The electronic assembly can also take the form of a custom integrated chip incorporating the functions described previously and making up a chip-on-board assembly. The entire package of FIG. 5 is a low profile triangular shape with rounded apexes. This package is a two piece clamshell construction that can be snapped, glued, or welded together. It is intended to be a throw-a-way assembly once the batteries are no longer functional. It would be activated by pulling a small strip of insulating film from between the battery terminal and a contact through a slot formed in the surface of one of the case halves. The case would be typically injection molded and might be a single piece with a living hinge molded in. The relative size is shown by comparison to a US quarter in FIG. 8. The Fresnel Lens can be hinged from one side or spring loaded so that it can be depressed when resting on a switch such as S1 in FIGS. 1 and 4. For this type of operation, the lens would glow at night due to light produced by at least one LED when the main momentary night light function is off. This feature provides the functions as described in conjunction with FIG. 3 above. If the user is in a dark place and needs light for a short time, he merely presses the lens to reactivate the momentary night light. FIG. 5 shows the LEDs separated from the light sensor (Pt). This lessens the interaction between the photo sensor and the LEDs, allowing the momentary night light to be turned back off automatically if the ambient light source is turned back on while the momentary night light is activated. This action can further improve battery life by not using the momentary night light when the ambient light is turned back on. It also resets the capacitor C1 shown in the above figures so that a new timing cycle can start if the ambient light source is turned back off abruptly.

Figure 7:
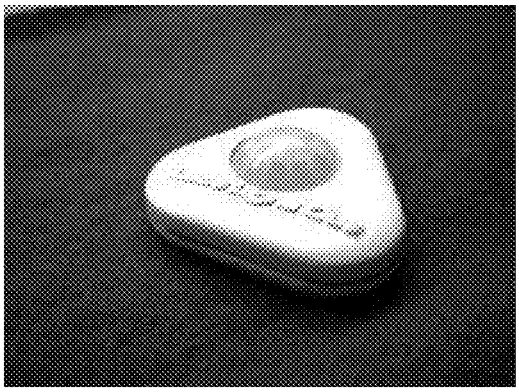
FIG. 7 is a perspective view showing a fifth embodiment of the momentary night light assembly of this invention.

FIG. 7 is an embodiment showing a momentary night light assembly with a slightly larger Fresnel lens. In this case, both the LEDs and the photo sensor are under the same lens. This lens also can glow at night and can activate S1 similar to that shown in FIG. 5. This configuration provides simpler construction than shown in FIG. 5 and the momentary night light can be activated by infrared remote control through the Fresnel lens as will be described later. This Fresnel lens is similar to 3Dlens.com no. 5114.

Figure 8:
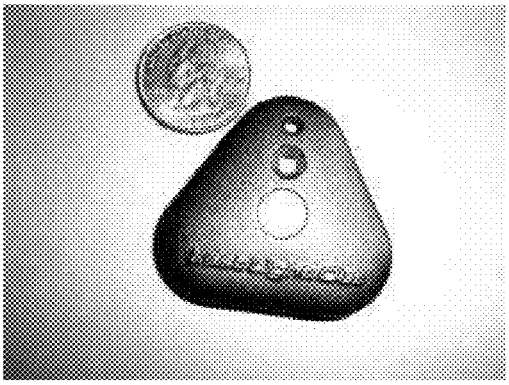
FIG. 8 is a plan view of a triangular shaped momentary night light assembly showing the relationship between the LED and the photo sensor.

FIG. 8 is an embodiment showing a triangular shaped package with separate openings for the light sensor and the LED. It contains a single LED circuit and a separate switch (S1) button in the center. In this case, no lenses are used.

Figure 13:
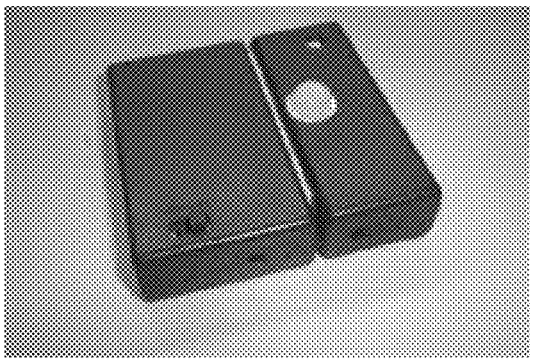
FIG. 13 is a perspective view with a lens showing a tenth embodiment of the momentary night light assembly of this invention.
Figure 14:
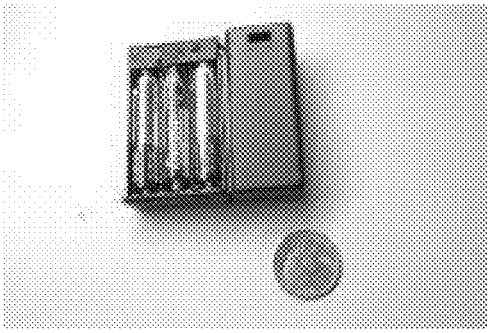
FIG. 14 is a plan view of a rectangular shaped momentary night light assembly showing the replaceable batteries.

This invention is not limited by the triangular shaped package and could be round, square, rectangular or some other shape. FIGS. 13 and 14 show an alternate package for the momentary night light having typically one LED and a low voltage battery pack, such as 3 alkaline cells in series providing about 4.5 volts. It has provisions for an on-off switch, a separate electronics section, and a removable battery cover so that the batteries can be replaced if desired. This can also be a throw-a-way package. The alkaline cells can provide long life bright light.

Figure 15:
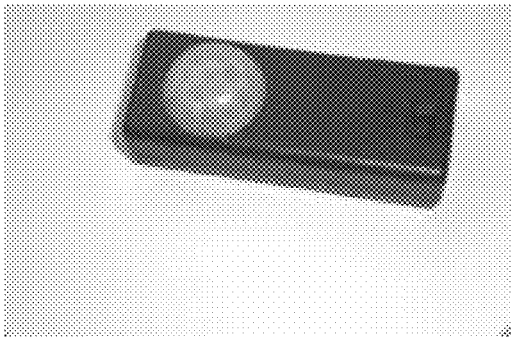
FIG. 15 is a perspective view of an assembly with a fresnel lens showing an eleventh embodiment of the momentary night light assembly of this invention.
Figure 16:
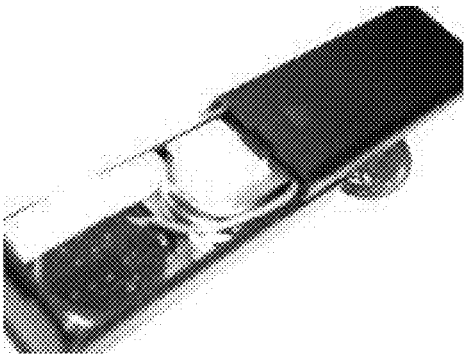
FIG. 16 is an opened perspective view of a circuit board assembly and stacked coin cell batteries showing a twelfth embodiment of the momentary night light assembly of this invention.

FIGS. 15 and 16 show an alternate momentary night light construction where there are 3 CR2032 coin cells in a vertical series-connected stack. The micro electronic circuit is the black object positioned behind the Fresnel lens. In this case, both the light sensor and the LEDs are behind the lens. The case can be opened as shown to change the batteries.

Figure 17:
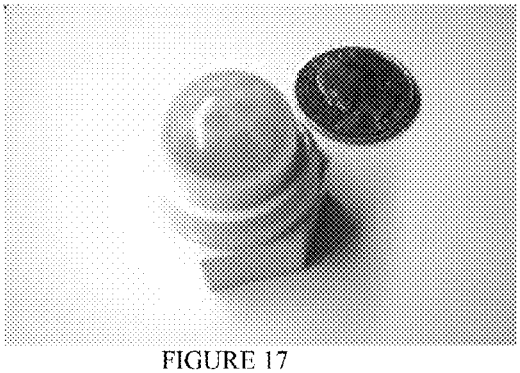
FIG. 17 is a miniature hexagonal shaped momentary night light assembly with a fresnel lens.
Figure 18:
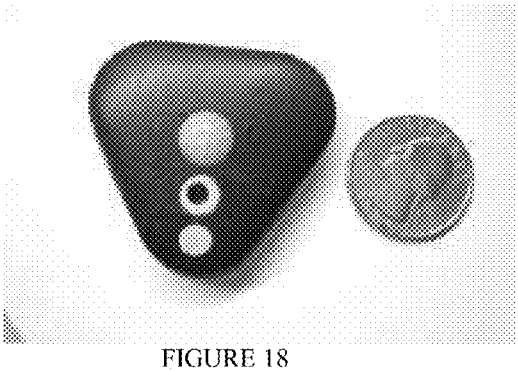
FIG. 18 is a top plan view of a triangular shaped momentary night light assembly.

FIGS. 17 and 18 compare the flat triangular package to a hexagonal shaped vertical package. The hexagonal shaped package can be designed to contain 2 or 3 coin cells in a vertical stack. The configuration shown in FIG. 17 is designed to be thrown away or recycled and has a 3Dlens.com 5114 type Fresnel lens. Both packages shown here can have an adhesive or a magnetic tape on the reverse side for mounting to various surfaces if desired.

Figure 19:
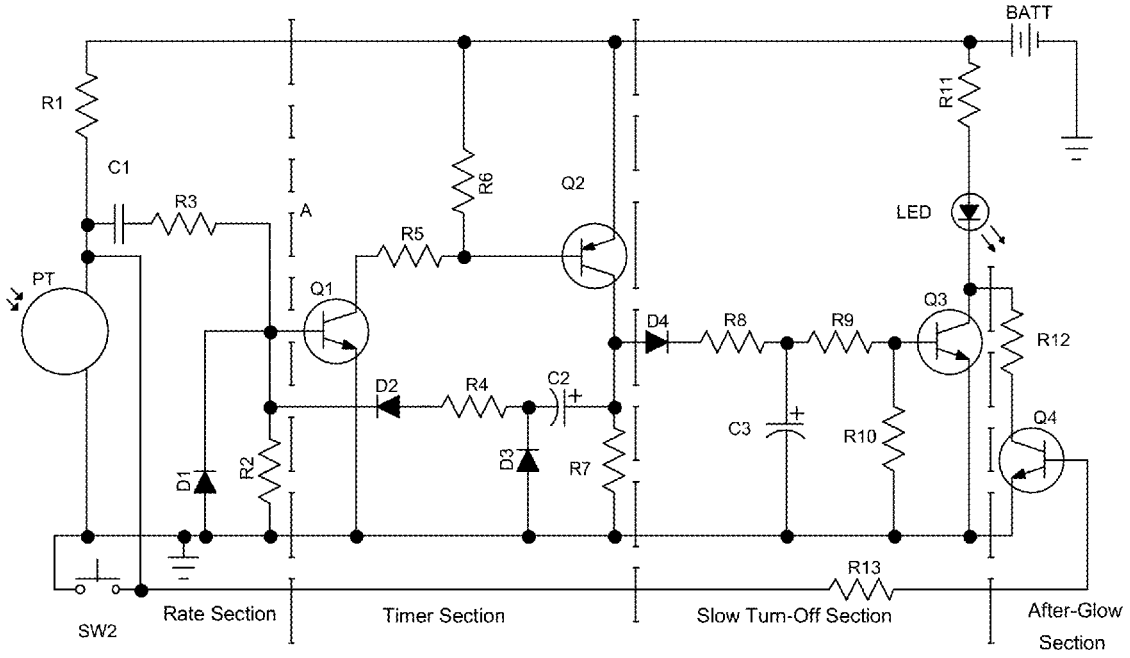
FIG. 19 is a schematic with four independent sensitivity adjustments showing a thirteenth embodiment of the momentary night light assembly of this invention.
Figure 19A:
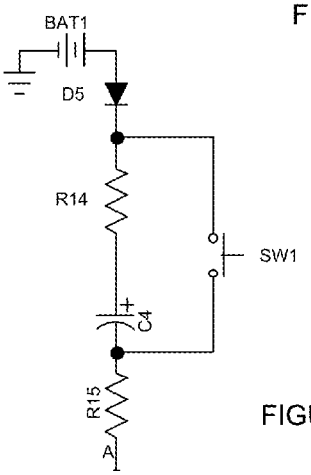
FIG. 19*a* shows an optional manually operated timer circuit for a momentary night light assembly of FIG. 19.

FIG. 19 is a preferred embodiment showing a momentary night light consisting of four independently adjustable sections. These are; rate section; timer section; slow turn-off section: and afterglow section. In addition, FIG. 19*a* shows an optional section that can be added at point (A) in FIG. 19. It provides for a manual timer function that can be activated by switch, S1. Diodes D1, D2, and D4 provide a degree of isolation between the sections shown in FIG. 19. The rate section is composed of a photo sensor (Pt) and resistors R1 and R2, along with capacitor C1. These component values determine the level of rate-of-change of ambient light intensity that is required to turn on Transistors Q1, Q2 and Q3 and light up the LED. This is generally a negative rate of change of light intensity; i.e., the ambient light is going from light to dark. These values are usually picked such that the ambient light is dim and changing rapidly, such as would be the case if the ambient light was a room light which is switched off suddenly. Appropriate values for these components prevent false triggering of Q1 with small changes of light intensity, such as the sun going down or slow moving shadows crossing the photo sensor (Pt). This prolongs battery life by not activating the LED when it is not required to do so. R3 and D1 form a low resistance discharge path for C1. When the ambient light is turned back on while the LED is still on, the photo sensor turns on and discharges C1 and shuts off Q1 causing the timer section to be reset and the LED to be turned off. D1 allows for a fast reset by bypassing R2. D2 prevents the feedback network composed of R4 and C2 from interfering with the trigger pulse from the rate section of the circuit. Thus the rate sensitivity and the "on-time" of the timer section can be adjusted more or less independently to suit the application. The "on-time" of the timer is set through R4 and C2 and the voltage divider composed of R5 and R6. The slow-off section of the circuit is isolated from the timer section by D4. When Q2 switches on, C3 quickly charges through D4 and R8 which turns on Q3 and the LED. Q2 is turned off when the timing section times out and Q3 gradually turns off by the slow discharge of C3 through R9 and R10. This causes the light intensity of the LED to reduce gradually, providing the Slow Turn-Off function. R12 and Q4 provide a small current to cause the LED to glow when the ambient light is dark so that a user can find the momentary night light in the dark in case it is desired to manually switch the momentary night light on. This function can also be made bright enough, by adjusting R12, to offer a nightlight function if desired. FIG. 19*a* shows a circuit to provide a manually switched timer function to the circuit of FIG. 19. It consist of the components shown and can provide an "on time" greater than the timer section of the circuit of FIG. 19. This allows a user to manually activate the momentary night light to perform some function in the dark that requires more time than given by the timer section of FIG. 19. The timer section of FIG. 19 can also be reset by S2 to provide a manual method using the normal timer section of FIG. 19. The timing function of FIG. 19*a* is started by closing switch S1 which discharges C4 through R13 and turns on Q1, Q2, Q3, and the LED. Releasing S1 starts the timing function by charging C4 through D5, R13, and R14, keeping the LED on until C4 is charged back up. Typical values of time (but not limiting) for the timer section of FIG. 19 is 1 to 1.5 minutes, whereas the time of the manual timer of FIG. 19*a* is set to 2 to 4 minutes. Both of these timers may be fixed or be made user adjustable by employing variable components in the design.

Although all of the battery powered momentary night light circuits are illustrated here with transistors, this invention is not limited by this implementation. The functions of these circuits could easily be constructed using standard digital logic chips, microprocessors, semi-custom, or custom integrated circuits. They may be discrete, surface mount, or chip-on-board type of construction.

All of the battery powered momentary night lights described herein have been endurance tested using a test cycle of 6 cycles per hour, where the momentary night light was on for about 1.25 minutes within each 10 minute period. This test was accomplished by cycling an external ambient light on and off in the presence of the photo sensor of the momentary night light assembly. Assuming the momentary night light would receive, on average, about 3 cycles per day then the total number of cycles in a year would be about 1100. Therefore, the test was accelerated to completion in less than 8 days. Using this accelerated test, it was demonstrated that all battery powered momentary night lights discussed herein would still be functional after one year's usage at the above rate of 3 cycles per day. Of course, more or less usage would alter the life projected here.

Figure 20:
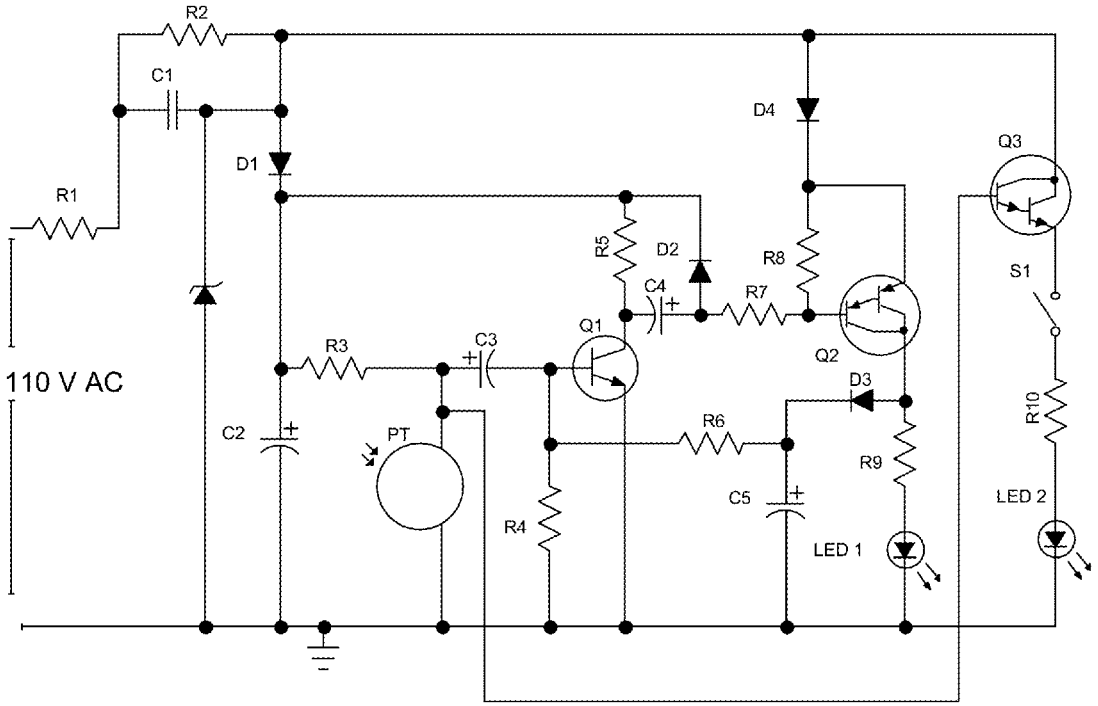
FIG. 20 is a 110 volt AC circuit schematic showing a fourteenth embodiment of the momentary night light assembly of this invention.
Figure 20A:
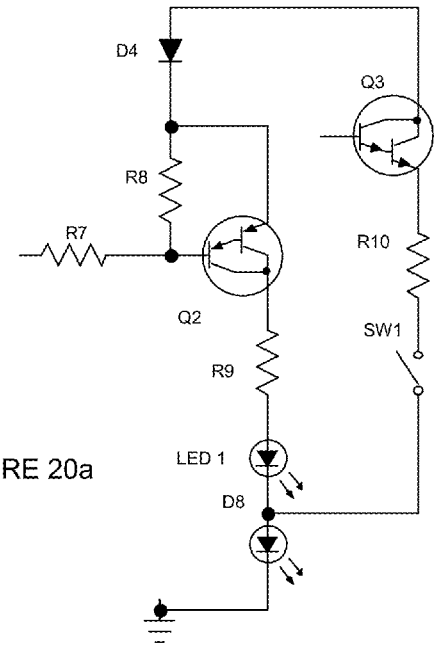
FIG. 20*a* shows a circuit for an alternate auxiliary night light function showing a fifteenth embodiment of the momentary night light assembly of this invention.

FIG. 20 is a preferred embodiment of a momentary night light circuit similar to the battery powered circuit of FIG. 4 except this circuit has added features to allow it to be powered from a typical 110 volt AC source. Resistor R1, C1, and the Zener diode reduce the 110 volt 60 cycle sine wave to an approximate 6.8 volt square wave. Resistor R2 provides a discharge path for capacitor C1 to prevent an accidental shock to a user when unplugged from an electrical outlet. Diode D1 and capacitor C2 form a low pass filter that provides a DC voltage level to the photo sensor (Pt) and the discharge circuit for the timing capacitor C4, made up of R5, C4, and D2. The charging current for the capacitor C4 and the Led current are supplied by a square wave pulse through diode D4. Diode D3 and capacitor C5 make up a filter that turns the square wave voltage pulse from Q2 to a DC feedback current through R6 to the base of Q1. Q2 also provides a repetitive current pulse through Resistor R9 to LED1. Other than the pulse features just described, this circuit operates substantially like the circuit shown in FIG. 4. C3 may be replaced by a solid connection as shown in the battery powered version of FIG. 1. FIG. 20*a* shows operation with dual Leds and the addition of Q3 and S1 to allow a normal night light addition that can be switch selected to provide optional night lighting after the momentary night light turns off.

Figure 21:
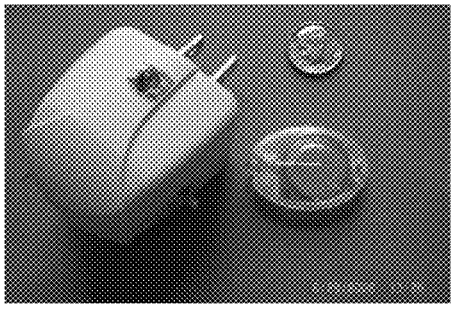
FIG. 21 show a perspective view of a 110V AC night light assembly showing a sixteenth embodiment of the momentary night light assembly of this invention.

FIG. 21 is a preferred embodiment for a 110 volt, 60 cycle momentary night light assembly which contains an optional night light feature. It contains the electric circuit described with FIGS. 20 and 20*a*. It plugs into a typical wall socket. The momentary night light comes from an LED mounted at a slight angle (10-15 degrees) away from the wall towards the ceiling. The night light can be switched on or off from a switch located in the side of the light shown in FIG. 21. The light from the night light comes from a separate LED out the bottom side towards the floor. The photo sensor is shown out the front of the light assembly shown in FIG. 21.

Figure 22:
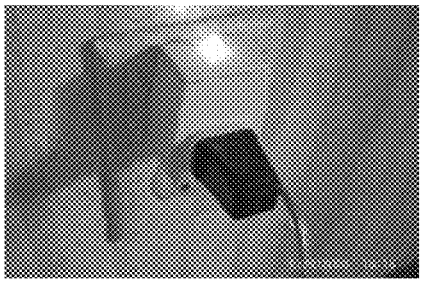
FIG. 22 shows a momentary night light assembly with a feed thru plug receptacle.
Figure 23:
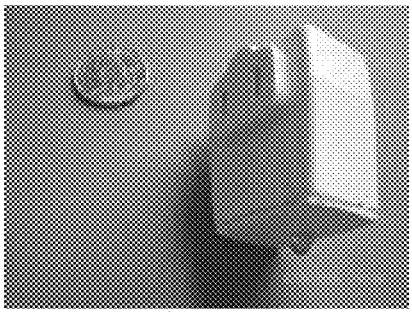
FIG. 23 is a perspective view of the momentary night light assembly of FIG. 22 showing the LED and the plug socket.
Figure 24:
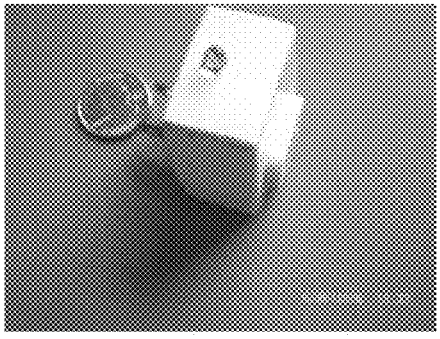
FIG. 24 shows a top view of the 110 volt AC momentary night light assembly showing a seventeenth embodiment of the momentary night light assembly of this invention.

FIGS. 22, 23, and 24 shows a momentary night light where the Led is mounted at a slight angle (10-15 degrees) away from the wall towards the ceiling and a feed-through receptacle is provided for a plug-in 110 volt appliance, such as a lamp.

Figure 25:
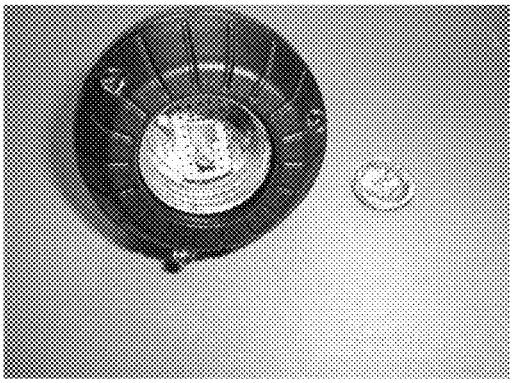
FIG. 25 is an end view of a lamp adapter showing an eighteenth embodiment of the momentary night light assembly of this invention.
Figure 26:
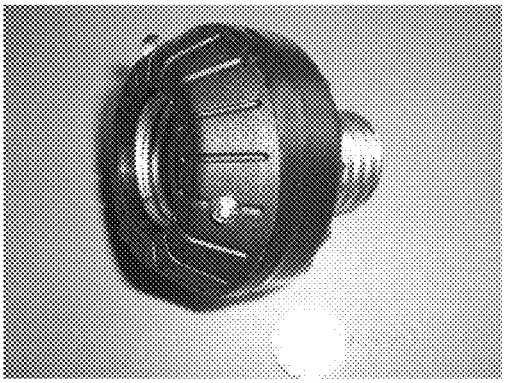
FIG. 26 is a perspective view of a momentary night light assembly lamp adapter showing the LED position and the screw-in base.

FIGS. 25 and 26 are embodiments showing a screw-in adapter assembly for a light or lamp having a multiple LED momentary night light. This package uses an energy storage element such as a battery or super capacitor. The storage element is charged up when the device that is plugged into the adapter is powered from a 110 volt line. When the 110 volt power source is turned off by an external switch, the storage device automatically applies a DC voltage to the LEDs for a short time period, thus providing a momentary night light. This type of circuit is more fully described in U.S. Pat. No. 7,253,570.

It has been found that all of the momentary night lights herein described, except that shown in FIGS. 25 and 26, can be controlled remotely, in addition to their automatic operation. The remote control is made possible by the fact that each system described can use an infrared phototransistor or diode as the photo sensor. It has been found by experiment that a short high intensity infrared pulse can turn the momentary night light on or off just as a similar change in ambient light does.

A preferred embodiment shown in FIG. 27 *a, b* and *c* consist of simple circuits to pulse the infrared diode used in a remote control for a momentary night light. An infrared LED found satisfactory in these circuits is an Optek OP290A with a 50 degree beam at 890 nm. Short pulse currents from about 150 ma up to 500 ma, when using this device, can give ranges from 6 feet to over 20 feet.

FIG. 27*a* shows the simplest of remote control devices. It consists of batteries (Batt), a normally open switch (S1) and the infrared diode. To operate, only a momentary closing and opening of the switch is required. The current in the LED is limited by the internal battery resistance. It has been found that the battery may be one or two 3 volt coin cells or two or three 1.5 volt alkaline button cells.

FIG. 27*b* shows a battery (Batt), a current limiting resistor R (which may also be the battery internal resistance) and a capacitor, C. The capacitor is continually charged by the battery until the switch, S1 is closed. When the switch is closed and then opened, a high current pulse can be applied to the infrared diode. This technique can extend the operating range of the remote control.

FIG. 27*c* shows the addition of a pulse shaping circuit (such as a monostable switch) to improve the reliability of operation and maximize battery life.

Remote control of the momentary night light can be especially useful if the momentary night light assembly is located some distance from the user. Under normal conditions, the momentary night light assembly works automatically to provide a short duration light source after an ambient light goes out. However, there may be times when a user wants to manually activate the momentary night light to perform some function in the dark, such as going from a bed to a bathroom. In this case the user can simply reach the momentary night light assembly and push a switch which will reactivate it as previously described. If the momentary night light assembly is remote from the user, then the remote control can be utilized. For example, the momentary night light assembly may be mounted on a ceiling or a wall or may be located on a remote surface. It may be a 110 volt version mounted in a remote wall outlet or integrated into a wall switch or switch cover. It could be integrated into a desk clock or wall clock, a picture frame, a mirror frame, a toy (such as a plush toy, a doll or a toy car) or a consumer electronic product such as a cell phone, an ipod, a computer, a computer mouse, a television or a radio. In each of these cases it may be desirable to use the remote for manual activation of the momentary night light assembly or combination with a night light. The electronic circuit in the momentary night light assembly/night light could also be configured to control the night light independently by coding the pulses. For example two quick pulses in succession might turn on the night light where a single pulse would activate the momentary night light assembly. Or another possibility would be to code the timer delay time such that a short time or a longer time could be selected for the momentary night light assembly to be activated. The remote control could also be integrated into a standard TV type remote control, or could be activated through a keypad or keyboard sequence.

FIG. 21 shows a prototype infrared LED remote control package beside the 110 volt momentary night light assembly previously described. It can be very small in size. It may also contain a small visible LED that glows at night so that it may be easily located in the dark.

Most people have experienced the visual effect when going abruptly from an environment of high ambient light intensity to one of low light intensity. When this happens it, at first, can be difficult or almost impossible to see in the low light environment. However, after a period of time, the eyes become "adjusted" to the lower light intensity and the person can then actually see objects clearly in the low light intensity environment. This can be easily demonstrated by going from a brightly lit room in your house to a dimly lit room, such as a bedroom with a dim nightlight. This phenomenon is well understood and explained by the physiology of the human eye. It is known that the maximum daylight sensitivity of the eye is centered on a light wavelength of 555 nano-meters (nm), whereas the maximum nighttime (reduced ambient light intensity) sensitivity is centered on 507 nm. In addition the absolute sensitivity of the eye is greatly increased under dark conditions. The nighttime vision is called Scotopic vision while the daytime vision is known as Photopic vision. The transition when going from Photopic vision to Scotopic is known as Mesopic vision. It is known that Photopic vision is primarily controlled by retinal cells called "cones", whereas Scotopic vision is controlled primarily by retinal cells called "rods".

Figure 28:
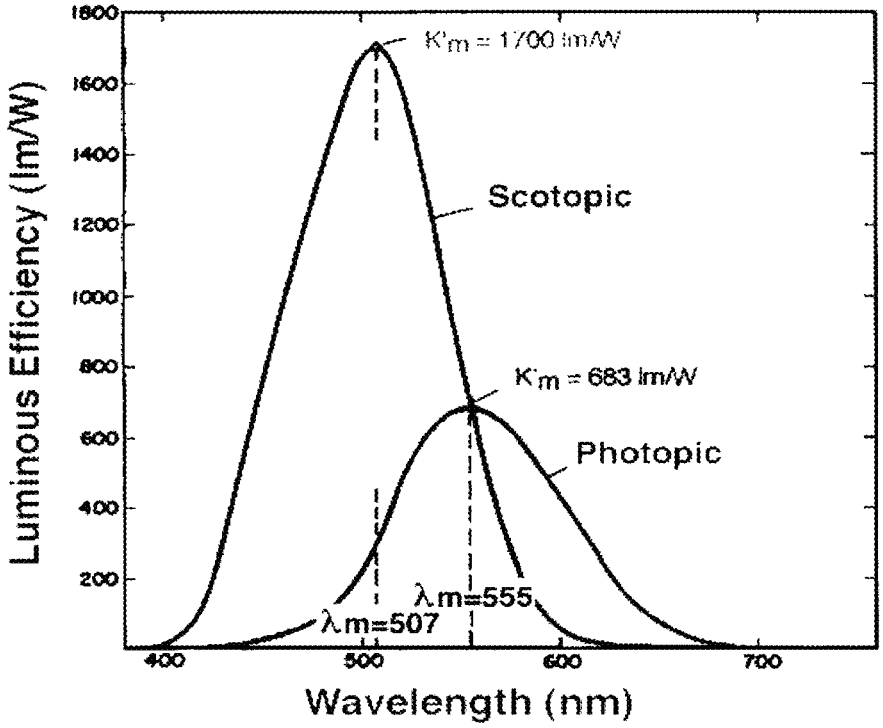
FIG. 28 shows the human eye response to different wavelengths of light.
Figure 29:
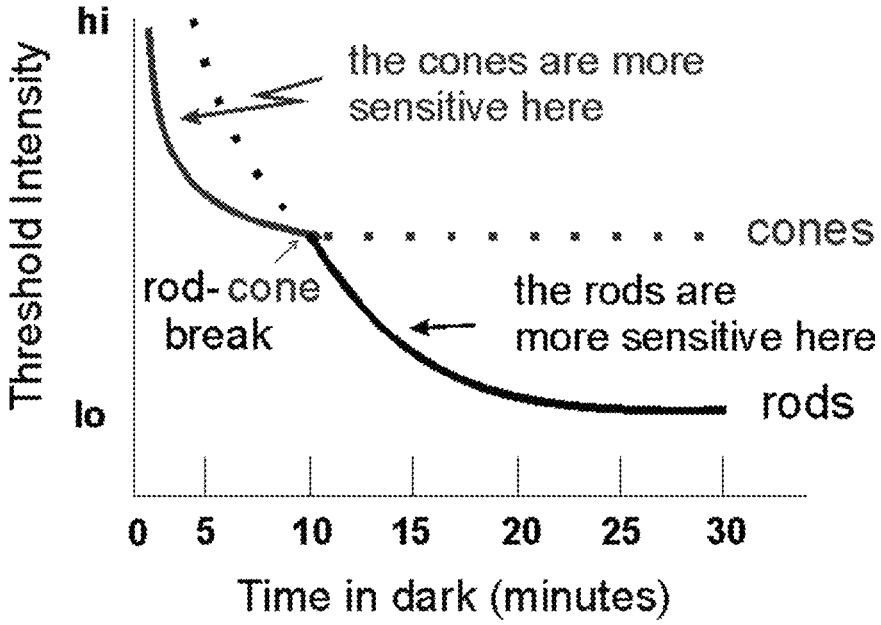
FIG. 29 shows the rate of human eye adaptation to a light to dark transition.

FIG. 28 illustrates the human eye response curves as a function of the wavelength of light. Notice that there is an overlap, but each curve has a definite peak response or sensitivity to light. FIG. 29 shows the time dependency characteristic of the human eye when suddenly going from a daylight environment to a nighttime environment. It can be seen from this curve that for the first approximately 5-8 minutes the eye detection threshold is high and primarily dependent upon the cones in the eye. However after this time, the eye sensitivity to the ambient light begins to improve (eye detection threshold reduces) and is primarily controlled by the rods in the eye. The rods in the eye contain a chemical dye known as rhodopsin, also known as visual purple. In the daylight this dye is bleached out and becomes clear, therefore minimizing the light sensitivity of the rods in bright light. However, in darkness, the dye slowly returns to purple color and consequently will then absorb very low levels of light, enabling sight in very dim environments. The cones can detect colors, whereas the rods detect only black and white intensity levels. However, the sensitivity of the rods is affected by the color of the ambient light at night as shown in FIG. 28. The best color for dim nightlights is blue-green (507 nm). The ratio of nighttime sensitivity to daytime sensitivity can easily be 1000 to 1 or greater. The transition region of the eye from the Photopic state to the Scotopic state of vision is called the Mesopic region of vision.

FIG. 29 indicates that an optimum night light would provide bright Photopic illumination initially, and then would change color and intensity with time to provide Scotopic illumination after 8 to 30 minutes from the initiation of an abrupt ambient light transition from light to dark.

Figure 31:
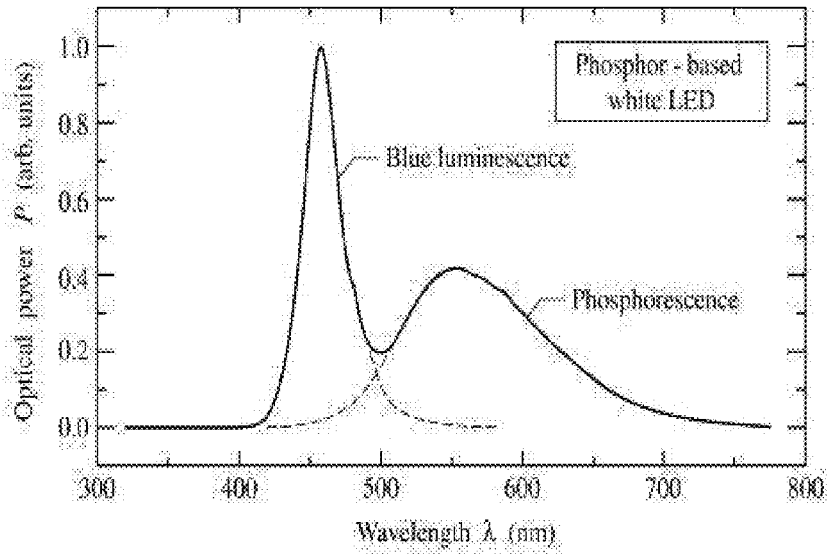
FIG. 31 is the spectrum of a white LED utilizing a blue chip in combination with a yellow phosphor.
Figure 32:
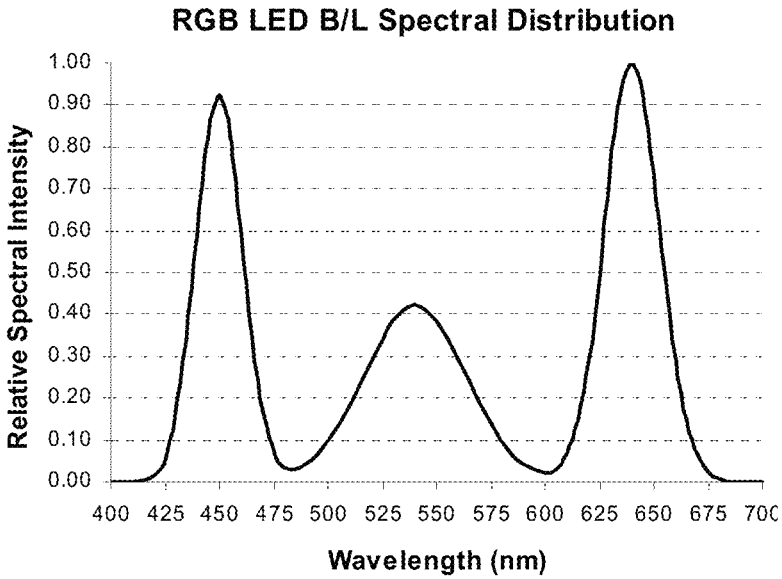
FIG. 32 shows the spectrum for a white LED containing independent blue, green, and red output colors.

The main light source used in this invention is an Indium-Gallium-Nitride (InGaN) "white" LED. These may be used as single or multiple LEDs. These devices typically use a blue or ultraviolet LED chip which is coated with a yellow phosphor material to provide a "quasi-white" light intensity spectrum as shown in FIG. 31. They tend to have a double "hump" with main component frequencies centered on 470 nm and 555 nm. Because of the peak near 500 nm, these lights can still provide significant Scotopic light, although at reduced efficiency. This type of LED material can provide significant light levels at low voltage and low current, making them useful for battery operation, while providing long battery life. Another type of white LED that can be used in this invention utilizes three separate chips; one blue, one green, and one red (RGB). This type of LED often has separate control of each chip to provide full controllable lighting from red to blue and mixtures (including white light) in between. FIG. 32 illustrates the light intensity spectrum of the RGB type of LED when operated in the white mode as a display backlight. One can see by controlling the intensity of each chip (RGB) independently, a night light can be created that can provide bright white light initially when the eye is still adjusted for Photopic vision and then gradually change color and reduce intensity during the period of time that the eye is adjusting through the Mesopic range to Scotopic vision. When going from a well lit room to a dark room, this transition would typically take about ½ of an hour.

Figure 34:
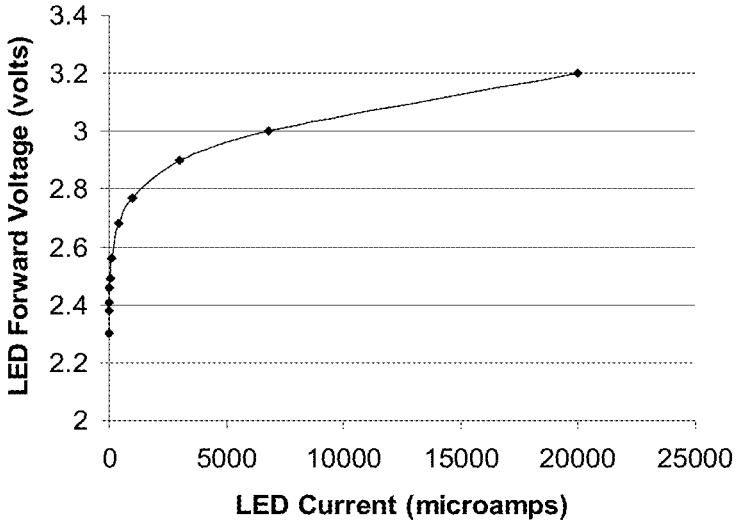
FIG. 34 shows the forwards voltage drop of a white LED versus the LED current for normal current levels.
Figure 35:
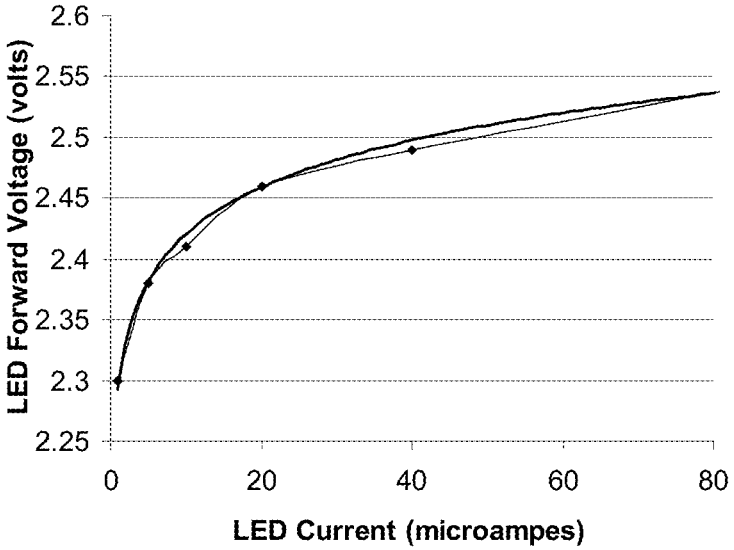
FIG. 35 shows the forward voltage drop of a white LED versus the LED current for small current levels.
Figure 36:
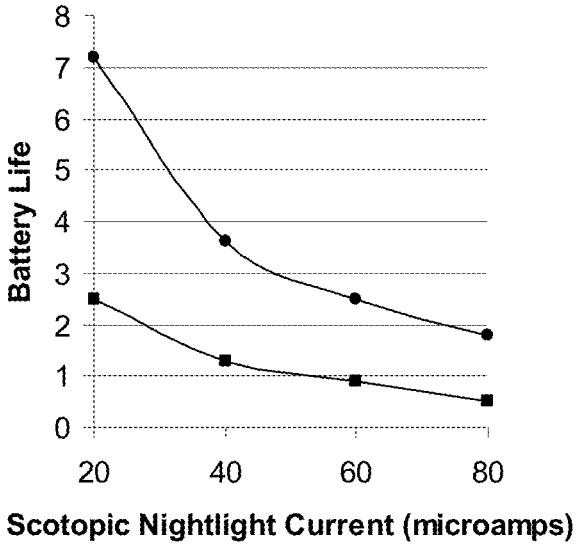
FIG. 36 shows battery life versus scotopic night light current for two different battery sizes.

At 507 nm (the optimum wavelength for scotopic vision) the eye is at its peak scotopic sensitivity, making blue-green LEDs optimum for night lights Most white LEDs are used in high brightness general lighting applications such as flash lights and general room lighting. In these applications the forward current can be from 20 ma to over one amp. The typical forward voltage drop at these current levels can run from 3.2 to 3.4 volts. A typical forward voltage drop for currents in the 20 ma range is shown as FIG. 34. When powered by batteries, these lights usually require three 1.5 volt cells or two 3 volt cells, or a single 6, 9 or 12 volt battery. I have found that InGaN led chips invented by Cree, Inc. and widely used by other companies for making LED devices produce enough light at very low currents to provide Scotopic night lighting. The intensity levels produced are sufficient for a fully night adapted eye to see objects in a dark room. FIG. 35 shows the region of operation for these very low current Scotopic night lights. For example, at 40 micro amps, the forward voltage drop is only about 2.5 volts. I have found that the range of useful current is from about 20 micro amps to about 60 micro amps. The low forward voltages produced at these currents allow the Scotopic night light to be powered from one 3 volt lithium cell which provides for an inexpensive very compact fixed intensity level Scotopic nightlight. These can be made from either white or blue-green LEDs as previously described. FIG. 36 shows the average battery life for two different 3 volt lithium cells as a function of Scotopic night light current level. For example, if the current level is 40 micro amps, then the life could be between about 1.5 to 3.5 years. This assumes that the light is only on in the dark. If the light is allowed to operate in the daytime then the lifetimes would be about half of those shown in FIG. 36.

Figure 37:
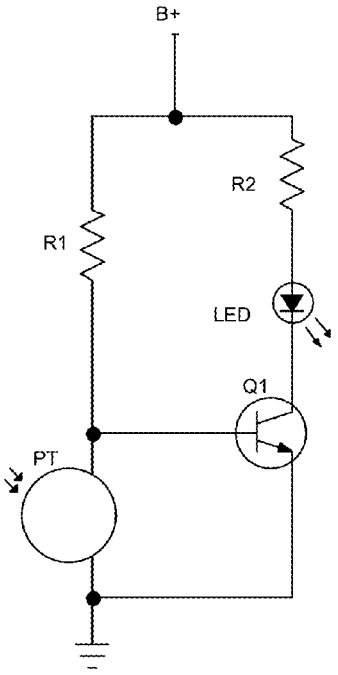
FIG. 37 is a schematic for a simple light controlled scotopic night light showing a twentieth embodiment of the momentary night light assembly of this invention.

FIG. 37 is a preferred embodiment showing a simple circuit for a fixed intensity throw-a-way Scotopic nightlight. It is based on a Nichia NSCW021 white LED operated at 40 micro amps. It could also use a blue-green LED as discussed earlier. An infrared photo-transistor and an inverting npn transistor provide the photo switch and current to the LED, only when the ambient light is very low, as in a dark room. This circuit requires only one 3 volt lithium cell, such as CR2032. As mentioned previously, the circuit could be further simplified by eliminating the transistor and the photocell, allowing the led to be always on. It would, however, reduce the lifetime of the battery by about a factor of 2. This type of Scotopic night light is simple, reliable, and low cost. They could be used for long periods of time in various rooms of a house, or hotel rooms. They are especially useful when getting out of bed in a dark room in the middle of the night after the eyes have become fully dark adapted. Once the battery is depleted, the Scotopic nightlight could be recycled or simply discarded.

Figure 38:
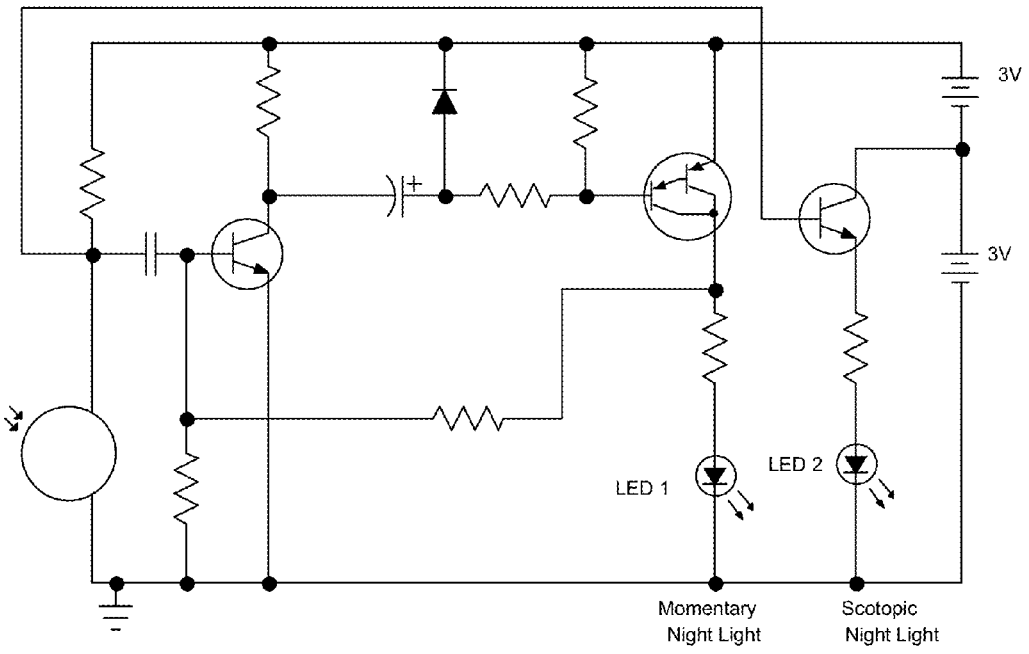
FIG. 38 is a circuit with the addition of a separate scotopic night light showing a twenty first embodiment of the momentary night light assembly of this invention.

FIG. 38, a preferred embodiment shows the application of a simple Scotopic nightlight in combination with a momentary night light assembly of the type shown in U.S. Pat. No. 7,253,570. Here a first LED is shown as LED1 where it functions as a bright white light for a short time period (1 to 5 minutes) following a sudden change from light to dark of the ambient light. LED2 could be a blue-green LED that glows when the ambient light is dark and becomes dominant after LED1 turns off and the user's eyes become fully dark adapted. LED2 could also be combined with LED1, so the single LED would provide both the brighter momentary night light and then the Scotopic night light function until the ambient light becomes bright again. This combination provides an inexpensive nightlight that allows the user to see objects when the eyes are in the mesopic range and then continues to provide Scotopic lighting to see objects in the darkened room.

Figure 39:
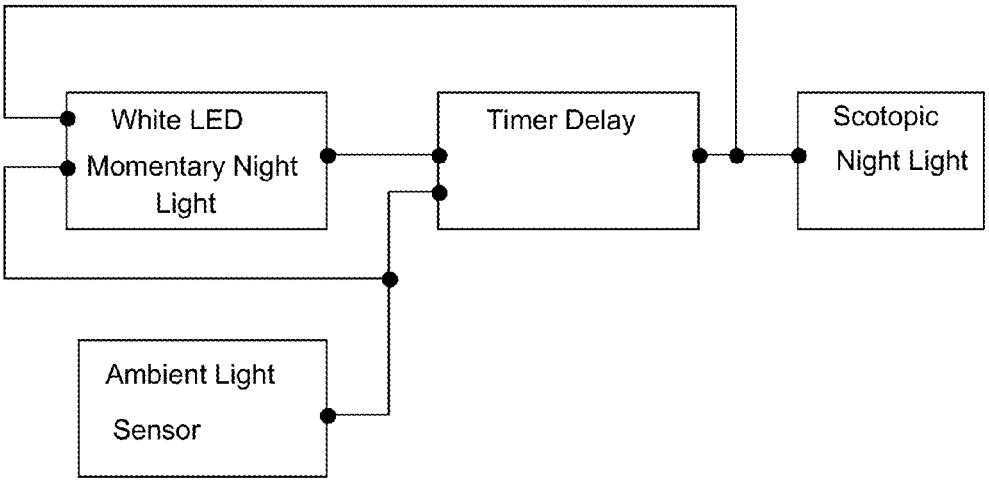
FIG. 39 is a block diagram for a momentary night light assembly with a separate scotopic night light.
Figure 40:
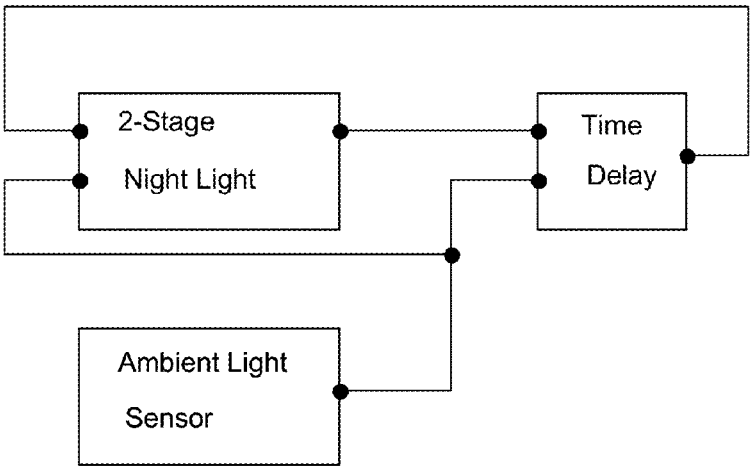
FIG. 40 is a block diagram for a combined momentary night light assembly and scotopic night light utilizing common LEDs.

FIGS. 39 and 40 are generalized block diagrams showing two alternative momentary night light assembly functions also having a supplemental night light function. FIG. 39 is the case where the momentary night light is a white LED. Once initiated by the ambient light sensor, sensing a light to dark transition, it turns on and then turns off following the timer delay. The Scotopic night light (having a separate light source) also turns on but remains on after the momentary night light assembly turns off. It turns off when the ambient space around it becomes light again. FIG. 40 shows a 2-stage night light that functions as a momentary night light assembly and then as a Scotopic night light utilizing a common light source.

The embodiment of FIG. 41 shows a time variable intensity, variable spectrum night light consisting of at least two LEDs. One could be white and the other could be blue-green. When the ambient light goes from light to dark a photo sensor triggers an electronic switch which provides a voltage to both LEDs and starts a clock which controls the three terminal devices which in turn controls the LED currents and thus the relative light intensity from each LED. The clock drives two or more counters which drive D/A converter resistive ladder networks to continuously vary the intensity level of the LEDs as a function of the prewired resistive networks and the output from the various counter stages. FIG. 41 also shows that the 3 terminal devices could be controlled by a microcontroller containing a clock and a ROM program that determines the time sequence for controlling the intensities of the LEDs. Either of these circuits could be used to provide light levels and spectrums that would track the expected change in eye sensitivity as shown in FIGS. 29 and 30. The 3-terminal LED control devices could take the form of voltage controlled resistors, field effect transistors, or conventional bi-polar transistors. The three terminal devices could be operated in an analog mode or could be switched by a variable duty cycle high frequency signal.

The embodiment of FIG. 42 is similar to FIG. 41 except the night light is composed of the primary colored LEDs (Red, Green, and Blue) which have time variable currents such that virtually any spectrum and light intensity can be created as a function of time. This night light can be preprogrammed to cover the entire mesopic range, starting with Photopic vision and ending with greatly reduced intensity and a shift to blue-green for best Scotopic vision.

Figure 43:
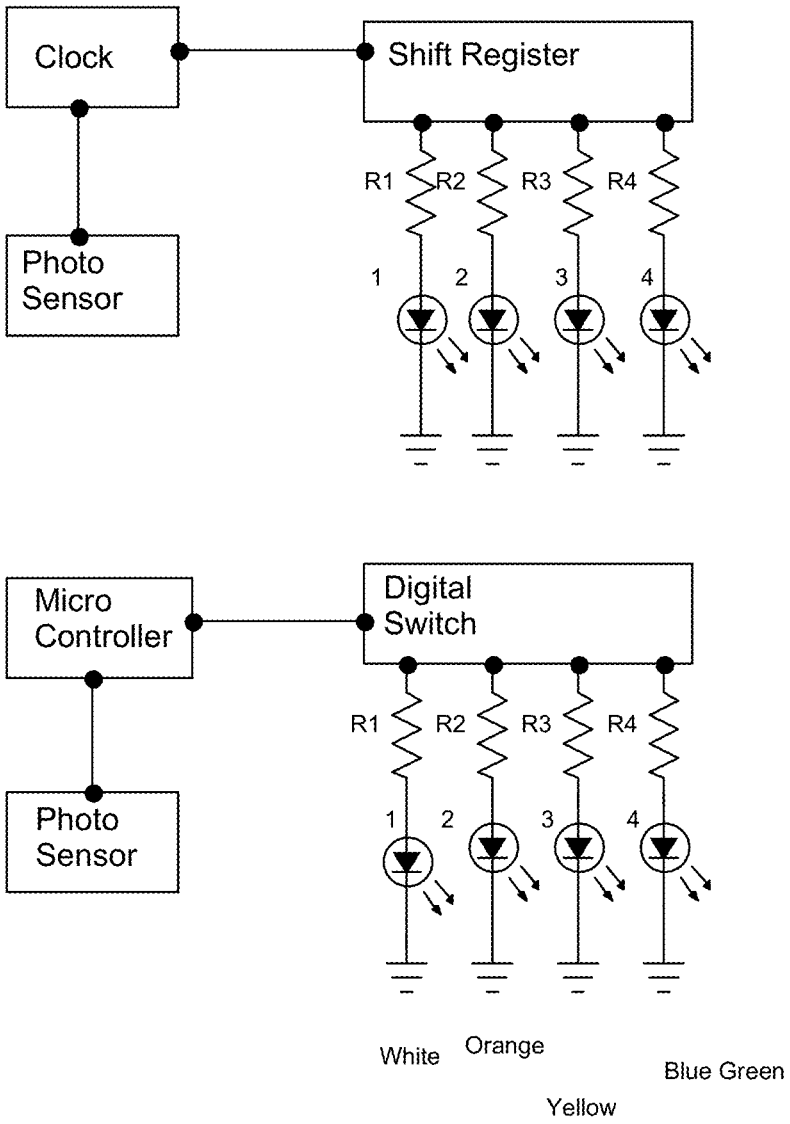
FIG. 43 is a time variable night light schematic showing a twenty fourth embodiment of the momentary night light assembly of this invention.

The embodiment FIG. 43 shows variable Scotopic night-lights created by multiple LEDs activated in sequence by control circuits. For example the LEDs could be different colors as shown, having their current levels preset by resistors. The LEDs would then be activated in the proper sequence by a clock and a shift register or by a Micro-controller and a digital switch so that the intensity levels and light spectrums could be changed to go from Photopic vision to Scotopic vision. This would occur over a typical time period of about ½ hour. These circuits are initiated from a photo sensor triggered by a light to dark transition of the ambient light.

Scotopic Nightlights are another preferred embodiment and can be integrated into hand held devices or computers, such as Cell phone, PDA's, and MP3 players. All of these examples would have a "normal" display backlight. In each case a nightlight function, including the Scotopic nightlight, could be programmed into the display by the user either by menu or directly by keypad. A single key function could also be programmed for switching on the nightlight function once it is programmed. A general nightlight control program could also be established by the manufacturer and could provide user selectable parameters to control light intensity, color, and timing of the night light feature. The control program would set the intensity and the color of the display backlight so that the night light using the display backlight would provide bright momentary night light initially for Photopic vision and then time shift the intensity downward and the backlight color towards the blue-green for Scotopic vision for the remainder of the night. The display backlight could be a full color LED backlight, or could simply be a white LED backlight, or white with blue-green LED capability. Instead of using the display backlight, the manufacturer could provide a dedicated programmable back light, such as a full color LED or LED array.

The Scotopic nightlight could be a plug-in module with or without a battery. This module with internal memory would plug into the Hand Held Device and could be user programmable as described above. It could have a single full color LED or it could have several LEDs of different color operated in sequence. This device would be programmed to change the light intensity and spectrum over time to provide Photonic vision at first and then some time later reduce to Scotopic vision levels.

A self contained Scotopic night light can be plugged into a USB bus or some other computer port for user programming. It would have a rechargeable battery and a programmable memory chip so that it could stand alone as a night light once programmed, or it could remain in the computer or programming device. It could have the same LED options as described above and function as a time variable night light going from Photopic to Scotopic levels of required light during a predetermined period of time.

The invention has been described in an illustrative manner. It is to be understood that the terminology and examples, which have been used, are intended to be in the nature of words of description rather than of limitation. Many modifications and variations of the invention are possible in light of the above teachings. Therefore, within the scope of the appended claims, the invention may be practiced other than as specifically described.

I claim:

1. A night light assembly containing a multiple LED light source and an electronic circuit, wherein said night light assembly is in a space normally lit by any ambient light; and said multiple LED light source is operatively controlled by said electronic circuit to produce a light output from said night light assembly; whereby said light output has a time varying intensity and a time varying light spectrum; and where said light output is initially a higher intensity photopic light output and then changes to a lower intensity scotopic light output during a first time period; where said first time period is less than or equal to the time period required by a normal human eye to adjust from photopic vision to scotopic vision following exposure of said human eye to a sudden reduction of an ambient light; said multiple LED light source is first turned on by said electronic circuit in response to a light-to-dark transition of said ambient light to initially produce said higher intensity photopic light output; said electronic circuit then gradually changes said higher intensity photopic light output from said multiple LED light source to said lower intensity scotopic light output during a said first time period; said lower intensity scotopic light output remains on during a second time period following said first time period until said electronic circuit senses a dark-to-light transition of said ambient light, after which said electronic circuit turns off said multiple LED light source.

2. The night light assembly of claim 1 wherein said multiple LED light source consists of one or more white LEDs and one or more blue-green LEDs.

3. The night light assembly of claim 1 wherein said electronic circuit contains two or more 3-terminal devices that supply currents to the said multiple LED light source.

4. The night light assembly of claim 3 wherein said 3-terminal device is a bi-polar transistor, a field effect transistor, or a voltage variable resistor.

5. The night light assembly of claim 3 wherein said 3-terminal device is controlled by a light control program stored in a memory in said electronic circuit, wherein said light control program causes the said 3-terminal devices to change said currents in said multiple LED light source as a function of time, thereby changing a light output from said multiple LED light source from a photopic light output to a scotopic light output.

6. The night light assembly of claim 5 wherein said light control program is a set of resistor values in a resistor ladder network which is contained in said electronic circuit; said resistor ladder network providing time varying voltage inputs to said 3-terminal devices to control said currents in said multiple LED light source to produce a light output from said multiple LED light source that changes from a photopic light output to a scotopic light output.

7. The night light assembly of claim 1 wherein said first time period is equal to or less than 30 minutes.

8. The night light assembly of claim 1 wherein a light control program is stored in a ROM (read only memory) which is a part of a micro controller that is contained in said electronic circuit; whereby said micro controller outputs analog or digital signals as a function of time to activate said multiple LED light source to produce a light output from said multiple LED light source that changes from a photopic light output to a scotopic light output.

9. The night light assembly of claim 1 wherein the multiple LED light source consists of one or more red, one or more blue, and one or more green LEDs.

10. The night light assembly of claim 1 wherein said multiple LED light source consists of at least two different colored LEDs.

11. The night light assembly of claim 10 wherein said different colored LEDs can produce a photopic light with a peak sensitivity centered at 555 nanometers and a scotopic light with a peak sensitivity centered at 507 nanometers.

12. The night light assembly of claim 1 wherein said electronic circuit activates said multiple led light source sequentially as a function of time to provide a light output from said multiple LED light source that changes from said photopic light output to said scotopic light output.

13. The night light assembly of claim 12 wherein said sequential activation of said multiple LED light source is accomplished with a shift register in combination with a clock.

14. The night light assembly of claim 12 wherein said sequential activation of said multiple LED light source is accomplished with a micro controller in combination with a digital switch.

* * * * *